US006763616B2

(12) United States Patent
Ellis, III

(10) Patent No.: US 6,763,616 B2
(45) **Date of Patent: *Jul. 20, 2004**

(54) SHOE SOLE STRUCTURES

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 278 days.

This patent is subject to a terminal disclaimer.

(21) Appl. No.: 09/933,821

(22) Filed: Aug. 22, 2001

(65) Prior Publication Data

US 2002/0007571 A1 Jan. 24, 2002

Related U.S. Application Data

(62) Division of application No. 08/390,288, filed on Feb. 15, 1995, now Pat. No. 6,295,744, which is a continuation of application No. 08/053,321, filed on Apr. 27, 1993, now abandoned, which is a continuation of application No. 07/539,870, filed on Jun. 18, 1990, now abandoned.

(51) Int. Cl.[7] ..... A43B 1/10; A43B 13/00

(52) U.S. Cl. ..... 36/102; 36/25 R

(58) Field of Search ..... 36/59 C, 59 R, 36/32 R, 25 R, 28, 29, 114, 116, 12, 107, 108, 102, 76 R, 30 R, 31

(56) References Cited

U.S. PATENT DOCUMENTS

| | | | |
|---|---|---|---|
| 280,791 | A | 7/1883 | Brooks |
| 500,385 | A | 6/1893 | Hall |
| 584,373 | A | 6/1897 | Kuhn |
| 1,115,922 | A | 11/1914 | Furber |
| 1,242,233 | A | 10/1917 | Pierce |

(List continued on next page.)

FOREIGN PATENT DOCUMENTS

| | | |
|---|---|---|
| CA | 1 176 458 | 10/1984 |
| DE | 23462 | 3/1883 |
| DE | 1 290 844 | 3/1969 |

(List continued on next page.)

OTHER PUBLICATIONS

German descriptions of adidas badminton shoes, pre–1989 (?).

Runner's World, Nov. 1988, p. 75, Advertisement for Nike Air Flow.

Runner's World, Oct. 1987, p. 60, Specifications on Turntec Road Warrior.

The Reebok Lineup, Fall 1987 (1 two–sided page).

Originally filed specification for U.S. patent application Ser. No. 08/234,590 filed Apr. 28, 1994 (FEE–013/Con).

Originally filed specification for U.S. patent application Ser. No. 09/621,453 filed Jul. 21, 2000 (FEE–10–02).

*Primary Examiner*—Marie D Patterson
(74) *Attorney, Agent, or Firm*—Knoble Yoshida & Dunleavy, LLC

(57) ABSTRACT

A construction for a shoe, particularly an athletic shoe, which includes a sole that conforms to the natural shape of the foot shoe, including the bottom and the sides, when that foot sole deforms naturally by flattening under load while walking or running in order to provide a stable support base for the foot and ankle. Deformation sipes such as slits or channels are introduced in horizontal plane of the shoe sole to provide it with flexibility roughly equivalent to that of the foot. The result is a shoe sole that accurately parallels the frontal plane deformation of the foot sole, which creates a stable base that is wide and flat even when tilted sideways in extreme pronation or supination motion. In marked contrast, conventional shoe soles are rigid and become highly unstable when tilted sideways because they are supported only by a thin bottom edge.

36 Claims, 6 Drawing Sheets

U.S. PATENT DOCUMENTS

| | | | | |
|---|---|---|---|---|
| D86,527 | S | | 3/1932 | Klein |
| 1,870,751 | A | | 8/1932 | Reach |
| 2,120,987 | A | | 6/1938 | Murray |
| 2,124,986 | A | | 7/1938 | Pipes |
| 2,135,725 | A | | 11/1938 | Merritt |
| 2,147,197 | A | | 2/1939 | Glidden |
| 2,155,166 | A | | 4/1939 | Kraft |
| 2,162,912 | A | | 6/1939 | Craver |
| D115,636 | S | | 7/1939 | Sperry |
| 2,201,300 | A | | 5/1940 | Prue |
| 2,206,860 | A | | 7/1940 | Sperry |
| 2,211,057 | A | | 8/1940 | Duckoff |
| 2,251,468 | A | | 8/1941 | Smith |
| 2,284,307 | A | | 5/1942 | Sperry |
| 2,328,242 | A | | 8/1943 | Witherill |
| 2,345,831 | A | | 4/1944 | Pierson |
| 2,470,200 | A | | 5/1949 | Wallach |
| 2,508,392 | A | | 5/1950 | Issaly |
| 2,627,676 | A | | 2/1953 | Hack |
| 2,757,461 | A | | 7/1956 | Cartmell |
| 2,922,235 | A | | 1/1960 | Meltzer |
| 3,087,261 | A | | 4/1963 | Russell |
| 3,087,262 | A | | 4/1963 | Russell |
| 3,114,981 | A | | 12/1963 | Murawski |
| 3,295,230 | A | | 1/1967 | Szerenyi et al. |
| 3,341,952 | A | | 9/1967 | Dassler |
| 3,487,563 | A | | 1/1970 | Austin |
| 3,507,057 | A | | 4/1970 | Olsson |
| 3,732,634 | A | | 5/1973 | Jacobson |
| 3,824,716 | A | | 7/1974 | Di Paolo |
| 3,834,046 | A | | 9/1974 | Fowler |
| 3,964,181 | A | * | 6/1976 | Holcombe, Jr. |
| 4,059,910 | A | | 11/1977 | Bryden et al. |
| 4,130,947 | A | | 12/1978 | Denu |
| 4,149,324 | A | | 4/1979 | Lesser et al. |
| 4,161,829 | A | | 7/1979 | Wayser |
| 4,240,214 | A | | 12/1980 | Sigle et al. |
| 4,245,406 | A | * | 1/1981 | Landay et al. |
| 4,281,467 | A | | 8/1981 | Anderie |
| 4,302,892 | A | | 12/1981 | Adamik |
| 4,308,671 | A | * | 1/1982 | Bretschneider |
| 4,309,831 | A | | 1/1982 | Pritt |
| 4,309,832 | A | | 1/1982 | Hunt |
| 4,316,332 | A | * | 2/1982 | Giese et al. ..... 36/114 |
| 4,335,530 | A | | 6/1982 | Stubblefield |
| 4,389,798 | A | | 6/1983 | Tilles |
| 4,393,605 | A | | 7/1983 | Spreng |
| 4,449,306 | A | | 5/1984 | Cavanagh |
| 4,454,662 | A | | 6/1984 | Stubblefield |
| 4,455,767 | A | | 6/1984 | Bergmans |
| 4,458,430 | A | * | 7/1984 | Peterson |
| 4,468,870 | A | | 9/1984 | Sternberg |
| 4,498,251 | A | | 2/1985 | Shin |
| 4,505,055 | A | | 3/1985 | Bergmans |
| D278,851 | S | | 5/1985 | Austin |
| 4,527,345 | A | | 7/1985 | Lopez Lopez |
| 4,542,598 | A | | 9/1985 | Misevich et al. |
| 4,547,979 | A | | 10/1985 | Harada et al. |
| 4,557,059 | A | | 12/1985 | Misevich et al. |
| 4,562,651 | A | | 1/1986 | Frederick et al. |
| 4,569,142 | A | | 2/1986 | Askinasi |
| 4,570,362 | A | | 2/1986 | Vermonet |
| 4,571,852 | A | | 2/1986 | Lamarche et al. |
| 4,611,412 | A | | 9/1986 | Cohen |
| 4,614,046 | A | * | 9/1986 | Dassler ..... 36/30 R |
| 4,615,126 | A | | 10/1986 | Mathews |
| 4,620,376 | A | | 11/1986 | Talarico, II |
| 4,624,061 | A | | 11/1986 | Wezel et al. |
| 4,624,062 | A | * | 11/1986 | Autry |
| 4,638,577 | A | | 1/1987 | Riggs |
| D288,027 | S | | 2/1987 | Tonkel |
| 4,654,983 | A | | 4/1987 | Graham et al. |
| 4,667,423 | A | | 5/1987 | Autry et al. |
| D293,275 | S | | 12/1987 | Bua |
| 4,715,133 | A | | 12/1987 | Hartjes et al. |
| 4,724,622 | A | | 2/1988 | Mills |
| 4,724,624 | A | | 2/1988 | Duclos |
| D294,425 | S | | 3/1988 | Le |
| D294,537 | S | | 3/1988 | Le |
| 4,731,939 | A | | 3/1988 | Parracho et al. |
| 4,733,483 | A | * | 3/1988 | Lin |
| D296,149 | S | | 6/1988 | Diaz |
| D296,152 | S | | 6/1988 | Selbiger |
| 4,748,753 | A | | 6/1988 | Ju |
| 4,753,021 | A | | 6/1988 | Cohen |
| 4,759,136 | A | | 7/1988 | Stewart et al. |
| 4,777,738 | A | | 10/1988 | Giese et al. |
| 4,779,361 | A | * | 10/1988 | Kinsaul |
| 4,782,603 | A | | 11/1988 | Brown |
| 4,783,910 | A | | 11/1988 | Boys, II et al. |
| 4,790,083 | A | | 12/1988 | Dufour |
| 4,798,010 | A | | 1/1989 | Sugiyama |
| 4,858,340 | A | | 8/1989 | Pasternak |
| 4,864,737 | A | | 9/1989 | Marrello |
| 4,864,739 | A | | 9/1989 | Maestri |
| 4,876,806 | A | | 10/1989 | Robinson et al. |
| 4,876,807 | A | | 10/1989 | Tiitola et al. |
| 4,878,300 | A | | 11/1989 | Bogaty |
| 4,887,367 | A | | 12/1989 | Mackness et al. |
| 4,890,398 | A | | 1/1990 | Thomasson |
| 4,894,932 | A | | 1/1990 | Harada et al. |
| 4,934,073 | A | | 6/1990 | Robinson |
| 4,937,954 | A | | 7/1990 | Clement |
| 4,989,349 | A | | 2/1991 | Ellis, III |
| 5,012,597 | A | | 5/1991 | Thomasson |
| 5,014,449 | A | | 5/1991 | Richard et al. |
| 5,025,573 | A | | 6/1991 | Giese et al. |
| 5,048,203 | A | | 9/1991 | Kling |
| 5,224,810 | A | | 7/1993 | Pitkin |
| 5,247,742 | A | | 9/1993 | Kilgore et al. |
| 5,317,819 | A | | 6/1994 | Ellis, III |
| 5,544,429 | A | | 8/1996 | Ellis, III |
| 5,909,948 | A | | 6/1999 | Ellis, III |
| 6,115,941 | A | | 9/2000 | Ellis, III |
| 6,115,945 | A | | 9/2000 | Ellis, III |
| 6,163,982 | A | | 12/2000 | Ellis, III |
| 6,295,744 | B1 | * | 10/2001 | Ellis, III |
| 6,308,439 | B1 | | 10/2001 | Ellis, III |
| 6,314,662 | B1 | | 11/2001 | Ellis, III |

FOREIGN PATENT DOCUMENTS

| | | |
|---|---|---|
| DE | 30 24 587 A1 | 1/1982 |
| DE | 32 22 975 | 2/1983 |
| EP | 0 069 083 | 1/1983 |
| EP | 0 083 449 | 7/1983 |
| FR | 337.366 | 4/1904 |
| FR | 825.941 | 3/1938 |
| FR | 1.034.194 | 7/1953 |
| FR | 1.096.539 | 6/1955 |
| FR | 1.187.325 | 9/1959 |
| GB | 53 | 10/1891 |
| GB | 9591 | 11/1913 |
| GB | 346771 | 4/1931 |
| GB | 471179 | 8/1937 |
| GB | 764956 | 1/1957 |
| GB | 2 001 843 | 2/1979 |
| GB | 2 007 081 | 5/1979 |
| GB | 11890 | 10/1982 |
| GB | 2 113 072 | 8/1983 |
| IT | 254536 | 8/1927 |
| IT | 443702 | 1/1949 |

| | | |
|---|---|---|
| IT | 479755 | 7/1950 |
| SU | 1590064 | 9/1990 |
| WO | WO 82/03754 | 11/1982 |
| WO | WO 83/03528 | 10/1983 |
| WO | WO 83/04166 | 12/1983 |
| WO | WO 87/07479 | 12/1987 |
| WO | WO 90/00358 | 1/1990 |
| WO | WO 91/00698 | 1/1991 |
| WO | WO 91/03180 | 3/1991 |
| WO | WO 91/04683 | 4/1991 |
| WO | WO 91/05491 | 5/1991 |
| WO | WO 91/10377 | 7/1991 |
| WO | WO 91/11124 | 8/1991 |
| WO | WO 91/11924 | 8/1991 |
| WO | WO 91/19429 | 12/1991 |
| WO | WO 92/07483 | 5/1992 |
| WO | WO 92/18024 | 10/1992 |
| WO | WO 94/03080 | 2/1994 |
| WO | WO 97/00029 | 1/1997 |
| WO | WO 00/54616 | 9/2000 |
| WO | WO 00/64293 | 11/2000 |
| WO | WO 01/80678 A2 | 11/2001 |

* cited by examiner

SHOE SOLE STRUCTURES

This application is a divisional of U.S. patent application Ser. No. 08/390,288, filed Feb. 15, 1995 now 6,925,744, allowed May 11, 2001; which is a continuation of U.S. patent application no. 08/053,321, filed Apr. 27, 1993, now abandoned; which is a continuation of U.S. patent application Ser. No. 07/539,870, filed Jun. 18, 1990, now abandoned.

BACKGROUND OF THE INVENTION

This invention relates generally to the structure of shoes. More specifically, this invention relates to the structure of athletic shoes. Still more particularly, this invention relates to shoe soles that conform to the natural shape of the foot sole, including the bottom and the sides, when the foot sole deforms naturally during locomotion in order to provide a stable support base for the foot and ankle. Still more particularly, this invention relates to the use of deformation sipes such as slits or channels in the shoe sole to provide it with sufficient flexibility to parallel the frontal plane deformation of the foot sole, which creates a stable base that is wide and flat even when tilted sideways in natural pronation and supination motion.

The applicant has introduced into the art the use of sipes to provide natural deformation paralleling the human foot in pending U.S. application Ser. No. 07/424,509, filed Oct. 20, 1989, and Ser. No. 07/478,579, filed Feb. 8, 1990. It is the object of this invention to elaborate upon those earlier applications to apply their general principles to other shoe sole structures, including those introduced in other earlier applications.

By way of introduction, the prior two applications elaborated almost exclusively on the use of sipes such as slits or channels that are preferably about perpendicular to the horizontal plane and about parallel to the sagittal plane, which coincides roughly with the long axis of the shoe; in addition, the sipes originated generally from the bottom of the shoe sole. This application will elaborate on use of sipes that instead originate generally from either or both sides of the shoe sole and are preferably about perpendicular to the sagittal plane and about parallel to the horizontal plane; that approach was introduced in the '509 application. Thus, this application will focus on sipes originating generally from either or both sides of the shoe sole, rather than from the bottom or top (or both) of the shoe sole.

In addition to the prior pending applications indicated above, the applicant has introduced into the art the concept of a theoretically ideal stability plane as a structural basis for shoe sole designs. That concept as implemented into shoes such as street shoes and athletic shoes is presented in U.S. Pat. No. 4,989,349, issued Feb. 5, 1991, and U.S. Pat. No. 5,317,819, issued Jun. 7, 1994, and in pending U.S. application numbers 07/400,714, filed on Aug. 30, 1989; Ser. No. 07/416,478, filed on Oct. 3, 1989; Ser. No. 07/463,302, filed on Jan. 10, 1990; and 07/469,313, filed on Jan. 24, 1990, as well as in PCT application no. PCT/US89/03076, filed on Jul. 14, 1989, which is generally comprised of virtually the entire '819 Patent verbatim (FIGS. 1–28) and major portions of the '349 Patent also verbatim (FIGS. 29–37) and was published as International Publication number WO 90/00358 on Jan. 25, 1990; PCT application no. PCT/US90/04917, which is comprised verbatim of the '714 application, except for FIGS. 13–15 (which were published as FIGS. 38–40 of WO 90/00358) and was published as International Publication number WO 91/03180 on Mar. 21, 1991; PCT application no. PCT/US90/05609, which is comprised verbatim of the '478 application and was published as International Publication number WO 91/04683 on Apr. 18, 1991; PCT application no. PCT/US90/06028, which is comprised verbatim of the '509 application and was published as International Publication number WO 91/05491 on May 2, 1991; PCT application no. PCT/US91/00028, which is comprised verbatim of the '302 application and was published as International Publication number WO 91/10377 on Jul. 25, 1991; PCT application no. PCT/US91/00374, which is comprised verbatim of the '313 application and was published as International Publication number WO 91/11124 on Aug. 8, 1991; and PCT application no. PCT/US91/00720, which is comprised verbatim of the '579 application and was published as International Publication number WO 91/11924 on Aug. 22, 1991. The purpose of the theoretically ideal stability plane as described in these applications was primarily to provide a neutral design that allows for natural foot and ankle biomechanics as close as possible to that between the foot and the ground, and to avoid the serious interference with natural foot and ankle biomechanics inherent in existing shoes.

The applicant's prior application on the sipe invention and the elaborations in this application are modifications of the inventions disclosed and claimed in the earlier applications and develop the application of the concept of the theoretically ideal stability plane to other shoe structures. Accordingly, it is a general object of the new invention to elaborate upon the application of the principle of the theoretically ideal stability plane to other shoe structures.

It is an overall objective of this application to show additional forms and variations of the general deformation sipes invention disclosed in the '509 and '579 applications, particularly showing its incorporation into the other inventions disclosed in the applicant's other applications.

These and other objects of the invention will become apparent from a detailed description of the invention which follows taken with the accompanying drawings.

BRIEF DESCRIPTION OF THE DRAWINGS

FIG. 1 shows that shoe when tilted 20 degrees outward, at the normal limit of ankle inversion.

DETAILED DESCRIPTION OF THE PREFERRED EMBODIMENTS

Figure 1:
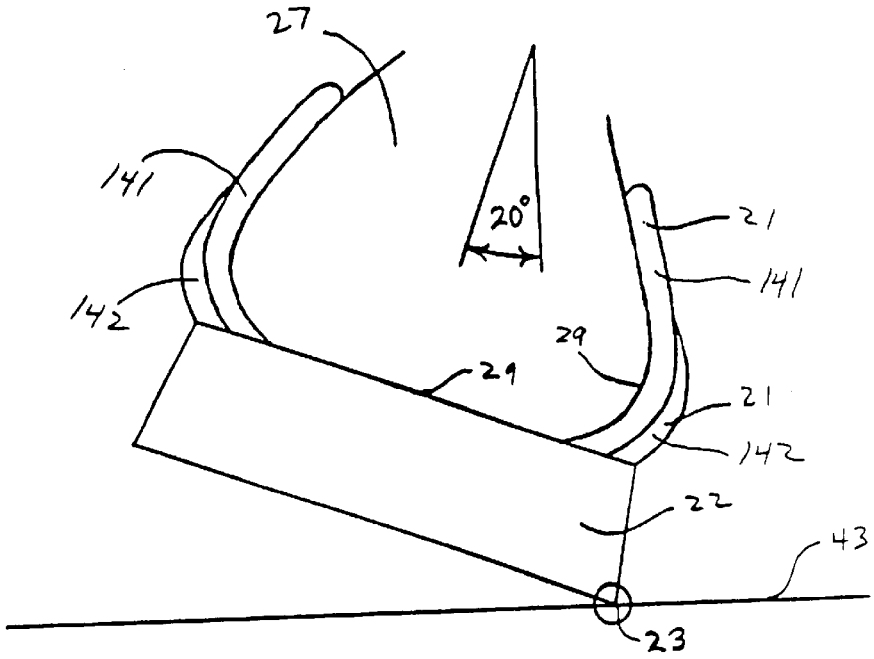
FIG. 1 shows, in frontal plane cross section at the heel portion of a shoe, a conventional modern running shoe with rigid heel counter and reinforcing motion control device and a conventional shoe sole.

FIG. 1 shows a conventional athletic shoe in cross section at the heel, with a conventional shoe sole 22 having essentially flat upper and lower surfaces and having both a strong heel counter 141 and an additional reinforcement in the form of motion control device 142. FIG. 1 specifically illustrates when that shoe is tilted outward laterally in 20 degrees of inversion motion at the normal natural limit of such motion in the barefoot. FIG. 1 demonstrates that the conventional shoe sole 22 functions as an essentially rigid structure in the frontal plane, maintaining its essentially flat, rectangular shape when tilted and supported only by its outside, lower corner edge 23, about which it moves in rotation on the ground 43 when tilted. Both heel counter 141 and motion control device 142 significantly enhance and increase the rigidity of the shoe sole 22 when tilted. All three structures serve to restrict and resist deformation of the shoe sole 22 under normal loads, including standing, walking and running. Indeed, the structural rigidity of most conventional street shoe materials alone, especially in the critical heel area, is usually enough to effectively prevent deformation.

Figure 2:
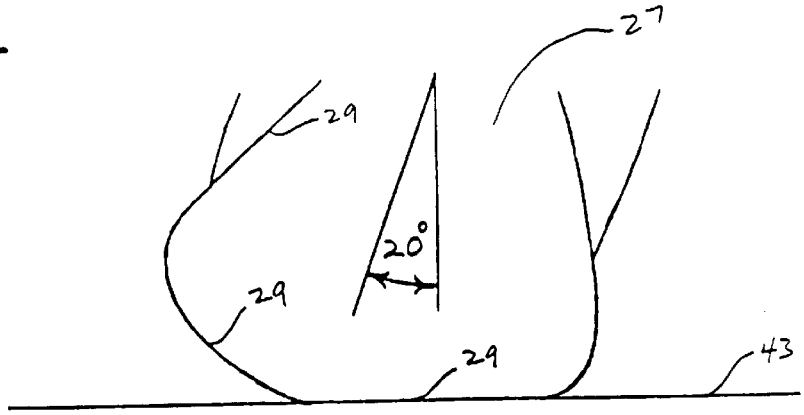
FIG. 2 shows, in frontal plane cross section at the heel, the human foot when tilted 20 degrees outward, at the normal limit of ankle inversion.

FIG. 2 shows a similar heel cross section of a barefoot tilted outward laterally at the normal 20 degree inversion maximum. In marked contrast to FIG. 1, FIG. 2 demonstrates that such normal tilting motion in the barefoot is accompanied by a very substantial amount of flattening deformation of the human foot sole, which has a pronounced rounded contour when unloaded, as will be seen in foot sole surface 29 later in FIG. 11.

FIG. 2 shows that in the critical heel area the barefoot maintains almost as great a flattened area of contact with the ground when tilted at its 20 degree maximum as when upright, as seen later in FIG. 3. In complete contrast, FIG. 1 indicate clearly that the conventional shoe sole changes in an instant from an area of contact with the ground 43 substantially greater than that of the barefoot, as much as 100 percent more when measuring in roughly the frontal plane, to a very narrow edge only in contact with the ground, an area of contact many times less than the barefoot. The unavoidable consequence of that difference is that the conventional shoe sole is inherently unstable and interrupts natural foot and ankle motion, creating a high and unnatural level of injuries, traumatic ankle sprains in particular and a multitude of chronic overuse injuries.

This critical stability difference between a barefoot and a conventional shoe has been dramatically demonstrated in the applicant's new and original ankle sprain simulation test described in detail in the applicant's earlier U.S. patent application Ser. No. 07/400,714, filed on Aug. 30, 1989 and was referred to also in both of his earlier applications previously noted here.

Figure 3:
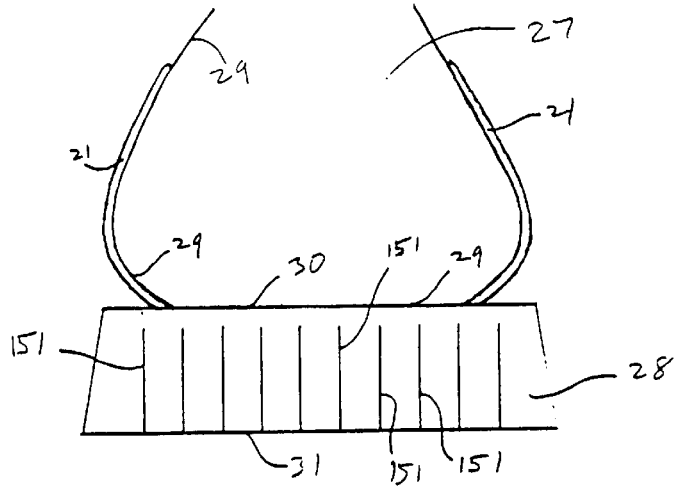
FIG. 3 shows, in frontal plane cross section at the heel portion, the applicant's prior invention in pending U.S. application Ser. No. 07/424,509, filed Oct. 20, 1989, of a conventional shoe sole with sipes in the form of deformation slits aligned in the vertical plane along the long axis of the shoe sole.

FIG. 3 shows, in frontal plane cross section at the heel, the applicant's prior invention of pending U.S. application Ser. No. 07/424,509, filed Oct. 20, 1989, the most clearcut benefit of which is to provide inherent stability similar to the barefoot in the ankle sprain simulation test mentioned above.

It does so by providing conventional shoe soles with sufficient flexibility to deform in parallel with the natural deformation of the foot. FIG. 3A indicates a conventional shoe sole into which have been introduced deformation slits 151, also called sipes, which are located optimally in the vertical plane and on the long axis of the shoe sole, or roughly in the sagittal plane, assuming the shoe is oriented straight ahead.

The deformation slits 151 can vary in number beginning with one, since even a single deformation slit offers improvement over an unmodified shoe sole, though obviously the more slits are used, the more closely can the surface of the shoe sole coincide naturally with the surface of the sole of the foot and deform in parallel with it. The space between slits can vary, regularly or irregularly or randomly. The deformation slits 151 can be evenly spaced, as shown, or at uneven intervals or at unsymmetrical intervals. The optimal orientation of the deformation slits 151 is coinciding with the vertical plane, but they can also be located at an angle to that plane.

The depth of the deformation slits 151 can vary. The greater the depth, the more flexibility is provided. Optimally, the slit depth should be deep enough to penetrate most but not all of the shoe sole, starting from the bottom surface 31, as shown in FIG. 3A.

A key element in the applicant's invention is the absence of either a conventional rigid heel counter or conventional rigid motion control devices, both of which significantly reduce flexibility in the frontal plane, as noted earlier in FIG. 1, in direct proportion to their relative size and rigidity. If not too extensive, the applicant's prior sipe invention still provide definite improvement.

Finally, it is another advantage of the invention to provide flexibility to a shoe sole even when the material of which it is composed is relatively firm to provide good support; without the invention, both firmness and flexibility would continue to be mutually exclusive and could not coexist in the same shoe sole.

Figure 4:
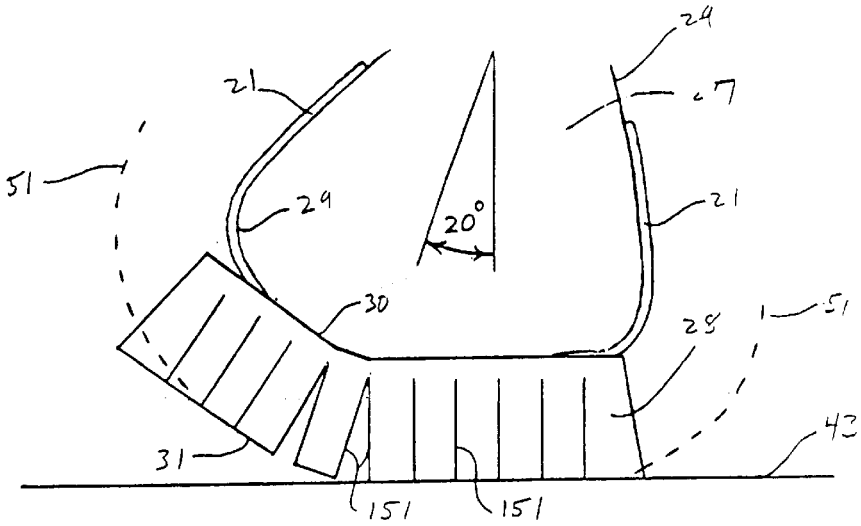
FIG. 4 is a view similar to FIG. 3, but with the shoe tilted 20 degrees outward, at the normal limit of ankle inversion, showing that the conventional shoe sole, as modified according to pending U.S. application Ser. No. 07/424,509, filed Oct. 20, 1989, can deform in a manner paralleling the wearer's foot, providing a wide and stable base of support in the frontal plane.

FIG. 4 shows, in frontal plane cross section at the heel, the applicant's prior invention of pending U.S. application Ser. No. 07/424,509, filed Oct. 20, 1989, showing the clearcut advantage of using the deformation slits 151 introduced in FIG. 3. With the substitution of flexibility for rigidity in the frontal plane, the shoe sole can duplicate virtually identically the natural deformation of the human foot, even when tilted to the limit of its normal range, as shown before in FIG. 2. The natural deformation capability of the shoe sole provided by the applicant's prior invention shown in FIG. 4 is in complete contrast to the conventional rigid shoe sole shown in FIG. 1, which cannot deform naturally and has virtually no flexibility in the frontal plane.

It should be noted that because the deformation sipes shoe sole invention shown in FIGS. 3 and 4, as well as other structures shown in the '509 application and in this application, allows the deformation of a modified conventional shoe sole to parallel closely the natural deformation of the barefoot, it maintains the natural stability and natural, uninterrupted motion of the barefoot throughout its normal range of sideways pronation and supination motion.

Indeed, a key feature of the applicant's prior invention is that it provides a means to modify existing shoe soles to allow them to deform so easily, with so little physical resistance, that the natural motion of the foot is not disrupted as it deforms naturally. This surprising result is possible even though the flat, roughly rectangular shape of the conventional shoe sole is retained and continues to exist except when it is deformed, however easily.

It should be noted that the deformation sipes shoe sole invention shown in FIGS. 3 and 4, as well as other structures shown in the '509 application and in this application, can be incorporated in the shoe sole structures described in the applicant's pending U.S. application Ser. No. 07/469,313, as well as those in the applicant's earlier applications, except where their use is obviously precluded. Relative specifically to the '313 application, the deformation sipes can provide a significant benefit on any portion of the shoe sole that is thick and firm enough to resist natural deformation due to rigidity, like in the forefoot of a negative heel shoe sole.

Note also that the principal function of the deformation sipes invention is to provide the otherwise rigid shoe sole with the capability of deforming easily to parallel, rather than obstruct, the natural deformation of the human foot when load-bearing and in motion, especially when in lateral motion and particularly such motion in the critical heel area occurring in the frontal plane or, alternately, perpendicular to the subtalar axis, or such lateral motion in the important base of the fifth metatarsal area occurring in the frontal plane. Other sipes exist in some other shoe sole structures that are in some ways similar to the deformation sipes invention described here, but none provides the critical capability to parallel the natural deformation motion of the foot sole, especially the critical heel and base of the fifth metatarsal, that is the fundamental process by which the lateral stability of the foot is assured during pronation and supination motion. The optimal depth and number of the deformation sipes is that which gives the essential support and propulsion structures of the shoe sole sufficient flexibility to deform easily in parallel with the natural deformation of the human foot.

Finally, note that there is an inherent engineering trade-off between the flexibility of the shoe sole material or materials and the depth of deformation sipes, as well as their shape and number; the more rigid the sole material, the more extensive must be the deformation sipes to provide natural deformation.

Figure 5:
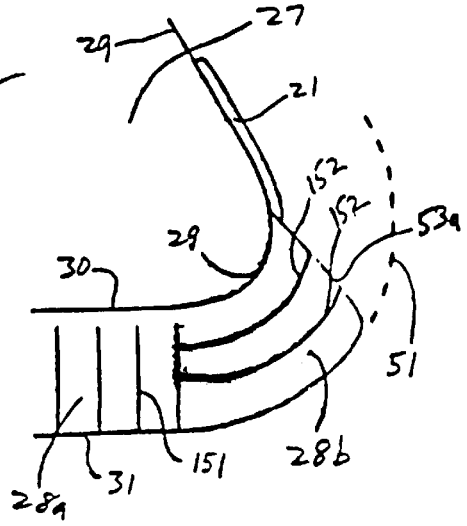
FIG. 5 is a view repeating FIG. 9B of pending Application No. '509 showing deformation slits applied to the applicant's prior naturally contoured sides invention, with additional slits on roughly the horizontal plane to aid natural deformation of the contoured side.
Figure 9B:
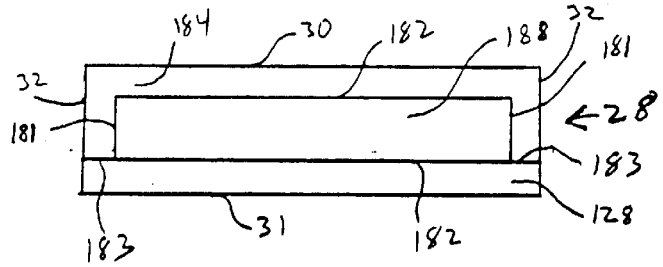
FIGS. 9A–C show a series of conventional shoe sole cross sections in the frontal plane at the heel utilizing both sagittal plane and horizontal plane sipes, and in which some or all of the sipes do not originate from any outer shoe sole surface, but rather are entirely internal.

FIG. 5 shows, in a portion of a frontal plane cross section at the heel, FIG. 9B of the applicant's prior invention of pending U.S. application Ser. No. 07/424,509, filed Oct. 20, 1989, showing the new deformation slit invention applied to the applicant's naturally contoured side invention, pending in U.S. application Ser. No. 07/239,667. The applicant's deformation slit design is applied to the sole portion 28*b* in FIGS. 4B, 4C, and 4D of the earlier application, to which are added a portion of a naturally contoured side 28 *a*, the outer surface of which lies along a theoretically ideal stability plane 51.

FIG. 5 also illustrates the use of deformation slits 152 aligned, roughly speaking, in the horizontal plane, though these planes are bent up, paralleling the sides of the foot and paralleling the theoretically ideal stability plane 51. The purpose of the deformation slits 152 is to facilitate the flattening of the naturally contoured side portion 28*b*, so that it can more easily follow the natural deformation of the wearer's foot in natural pronation and supination, no matter how extreme. The deformation slits 152, as shown in FIG. 5 would, in effect, coincide with the lamination boundaries of an evenly spaced, three layer shoe sole, even though that point is only conceptual and they would preferably be of injection molding shoe sole construction in order to hold the contour better.

The function of deformation slits 152 is to allow the layers to slide horizontally relative to each other, to ease deformation, rather than to open up an angular gap as deformation slits or channels 151 do functionally. Consequently, deformation slits 152 would not be glued together, just as deformation slits 152 are not, though, in contrast, deformation slits 152 could be glued loosely together with a very elastic, flexible glue that allows sufficient relative sliding motion, whereas it is not anticipated, though possible, that a glue or other deforming material of satisfactory consistency could be used to join deformation slits 151.

Optimally, deformation slits 152 would parallel the theoretically ideal stability plane 51, but could be at an angle thereto or irregular rather than a curved plane or flat to reduce construction difficulty and therefore cost of cutting when the sides have already been cast.

The deformation slits 152 approach can be used by themselves or in conjunction with the shoe sole construction and natural deformation outlined in FIG. 9 of pending U.S. application Ser. No. 07/400,714; they can also be used in conjunction with shoe sole structures in pending U.S. application Ser. No. 07/416,478, filed on Oct. 3, 1989.

The number of deformation slits 152 can vary like deformation slits 151 from one to any practical number and their depth can vary throughout the contoured side portion 28*b*. It is also possible, though not shown, for the deformation slits 152 to originate from an inner gap between shoe sole sections 28*a* and 28*b*, and end somewhat before the outside edge 53*a* of the contoured side 28*b*.

Figure 6A:
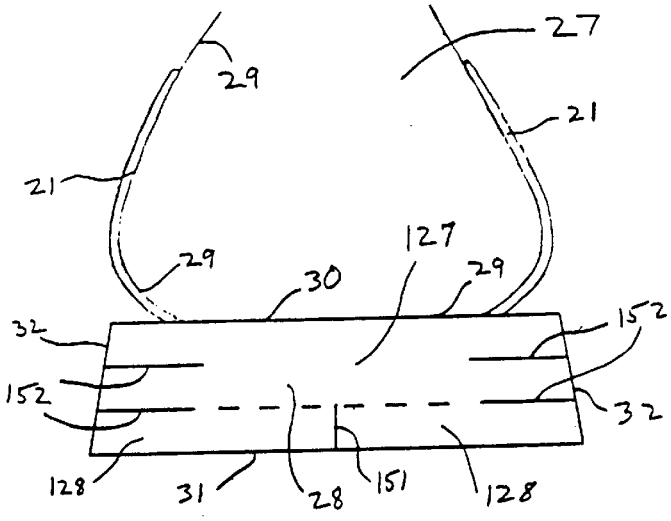
FIG. 6A is a frontal plane cross section at the heel of a conventional shoe with a sole that utilizes both horizontal and sagittal plane slits.

FIG. 6A shows, in a frontal plane cross section at the heel, a shoe sole with a combination like FIG. 5 of both sagittal plane deformation slits 151 and horizontal plane deformation slits 152. It shows deformation slits 152 in the horizontal plane applied to a conventional shoe having a sole structure with moderate side flare and without either reinforced heel counter or other motion control devices that would obstruct the natural deformation of the shoe sole. The deformation slits 152 can extend all the way around the periphery of the shoe sole, or can be limited to one or more anatomical areas like the heel, where the typically greater thickness of the shoe sole otherwise would make deformation difficult; for the same reason, a negative heel shoe sole would need deformation enhancement of the thicker forefoot.

Also shown in FIG. 6A is a single deformation slit 151 in the sagittal plane extending only through the bottom sole 128; even as a minimalist structure, such a single deformation sipe, by itself alone, has considerable effect in facilitating natural deformation, but it can enlarged or supplemented by other sipes. The lowest horizontal slit 152 is shown located between the bottom sole 128 and the midsole 127.

Figure 6B:
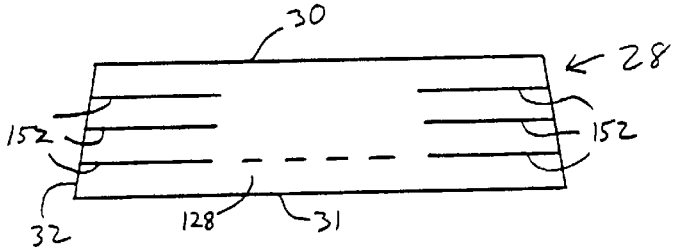
FIG. 6B and FIG. 6C show other conventional shoe soles with other variations of horizontal plane deformation slits originating from the sides of the shoe sole.

FIG. 6B shows, in frontal plane cross section at the heel, a similar conventional shoe sole structure with more and deeper deformation slits 152, which can be used without any deformation slits 151.

The advantage of horizontal plane deformation slits 152, compared to sagittal plane deformation slits 151, is that the normal weight-bearing load of the wearer acts to force together the sections separated by the horizontal slits so that those sections are stabilized by the natural compression, as if they were glued together into a single unit, so that the entire structure of the shoe sole reacts under compression much like one without deformation slits in terms of providing a roughly equivalent amount of cushioning and protection. In other words, under compression those localized sections become relatively rigidly supporting while flattened out directly under the flattened load-bearing portion of the foot sole, even though the deformation slits 152 allow flexibility like that of the foot sole, so that the shoe sole does not act as a single lever as discussed in FIG. 1.

In contrast, deformation sipes 151 are parallel to the force of the load-bearing weight of the wearer and therefore the shoe sole sections between those sipes 151 are not forced together directly by that weight and stabilized inherently, like slits 152. Compensation for this problem in the form of firmer shoe sole material than are used conventionally may provide equivalently rigid support, particularly at the sides of the shoe sole, or deformation slits 152 may be preferable at the sides.

Figure 6C:
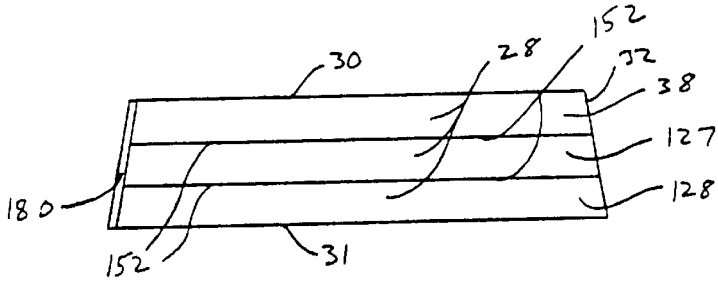

FIG. 6C shows, in frontal plane cross section at the heel, a similar conventional shoe sole structure horizontal plane deformation sipes 152 extending all the way from one side of the shoe sole to the other side, either coinciding with lamination layers—heel wedge 38, midsole 127, and bottom sole 128—in older methods of athletic shoe sole construction or molded in during the more modern injection molding process. The point of the FIG. 6C design is that, if the laminated layers which are conventionally glued together in a rigidly fixed position can instead undergo sliding motion relative to each other, then they become flexible enough to conform to the ever changing shape of the foot sole in motion while at the same time continuing to provide about the same degree of necessary direct structural support.

Such separated lamination layers would be held together only at the outside edge by a layer of elastic material or fabric 180 bonded to the lamination layers 38, 127 and 128, as shown on the left side of FIG. 6C. The elasticity of the edge layer 180 should be sufficient to avoid inhibiting significantly the sliding motion between the lamination layers. The elastic edge layer 180 can also be used with horizontal deformation slits 152 that do not extend completely across the shoe sole, like those of FIGS. 6A and 6B, and would be useful in keeping the outer edge together, keeping it from flapping down and catching on objects, thus avoiding tripping. The elastic layer 180 can be connected directly to the shoe upper, preferably overlapping it.

The deformation slit structures shown in conventional shoe soles in FIG. 6 can also be applied to the applicant's quadrant sides, naturally contoured sides and fully contoured sides inventions, including those with greater or lesser side thickness, as well as to other shoe sole structures in his other prior applications already cited.

If the elastic edge layer 180 is not used, or in conjunction with its use, the lamination layers can be attached with a glue or other connecting material of sufficient elasticity to allow the shoe sole to deformation naturally like the foot.

Figure 7:
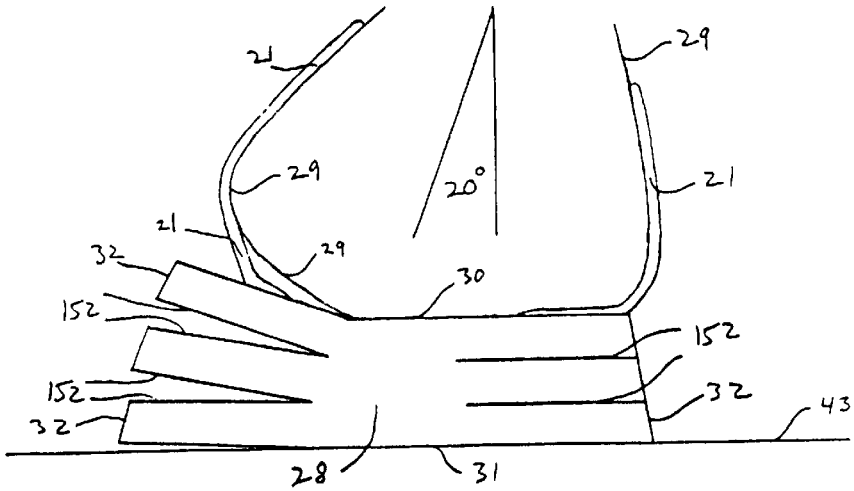
FIG. 7 is a frontal plane cross section at the heel of a conventional shoe of the right foot utilizing horizontal plane deformation slits and tilted outward about 20 degrees to the normal limit of ankle motion.

FIG. 7 shows, in frontal plane cross section at the heel, a conventional shoe with horizontal plane deformation slits 152 with the wearer's right foot inverted 20 degrees to the outside at about its normal limit of motion. FIG. 7 shows how the use of horizontal plane deformation slits 152 allows the natural motion of the foot to occur without obstruction. The attachments of the shoe upper are shown conventionally, but it should be noted that such attachments are a major cause of the accordion-like effect of the inside edge of the shoe sole. If the attachments on both sides were move inward closer to the center of the shoe sole, then the slit areas would not be pulled up, leaving the shoe sole with horizontal plane deformation slits laying roughly flat on the ground with a convention, un-accordion-like appearance.

FIG. 8 shows, again in frontal plane cross section at the heel, a conventional shoe sole structure with deformation slits 152 enlarged to horizontal plane channels, broadening the definition to horizontal plane deformation sipes 152, like the very broad definition given to sagittal plane deformations sipes 151 in both earlier applications, Nos. '509 and '579. In contrast to sagittal plane deformation sipes 151, however, the voids created by horizontal plane deformation sipes 152 must be filled by a material that is sufficiently elastic to allow the shoe sole to deform naturally like the foot while at the same time providing structural support.

Certainly, as defined most simply in terms of horizontal plane channels, the voids created must be filled to provide direct structural support or the areas with deformation sipes 152 would sag. However, just as in the case of sagittal plane deformation sipes 151, which were geometrically defined as broadly as possibly in the prior applications, the horizontal plane deformation sipes 152 are intended to include any conceivable shape and certainly to include any already conceived in the form of existing sipes in either shoe soles or automobile tire. For example, deformation sipes in the form of hollow cylindrical aligned parallel in the horizontal plane and sufficiently closely spaced would provide a degree of both flexibility and structural support sufficient to provide shoe sole deformation much closer to that of the foot than conventional shoe soles. Similarly, such cylinders, whether hollow or filled with elastic material, could also be used with sagittal plane deformation sipes, as could any other shape.

It should be emphasized that the broadest possible geometric definition is intended for deformation sipes in the horizontal plane, as has already been established for deformation sipes in the sagittal plane. There can be the same very wide variations with regard to deformation sipe depth, frequency, shape of channels or other structures (regular or otherwise), orientation within a plane or obliqueness to it, consistency of pattern or randomness, relative or absolute size, and symmetry or lack thereof.

Figure 8:
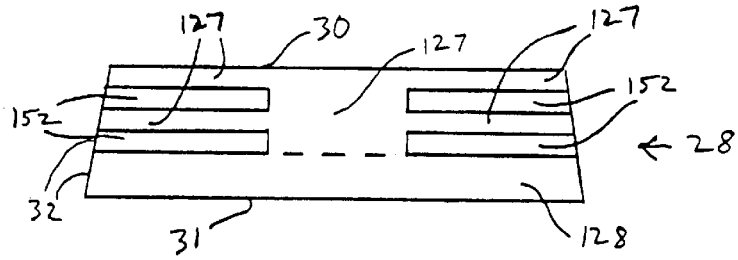
FIG. 8 is a frontal plane cross section at the heel of a conventional shoe with horizontal plane sipes in the form of slits that have been enlarged to channels, which contain an elastic supportive material.

The FIG. 8 design applies also to the applicant's earlier naturally contoured sides and fully contoured inventions, including those with greater or lesser side thickness; although not shown, the FIG. 8 design, as well as those in FIGS. 6 and 7, could use a shoe sole density variation like that in the applicant's pending U.S. application Ser. No. 07/416,478, filed on Oct. 3, 1989, as shown in FIG. 7 of the No. '579 application.

Figure 9C:
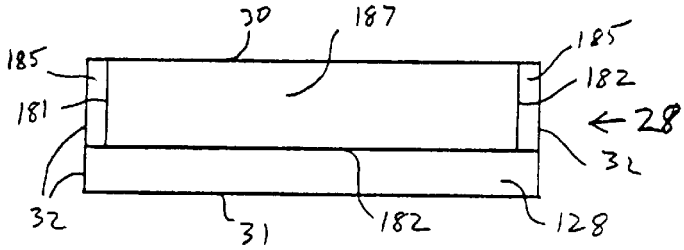
Figure 9A:
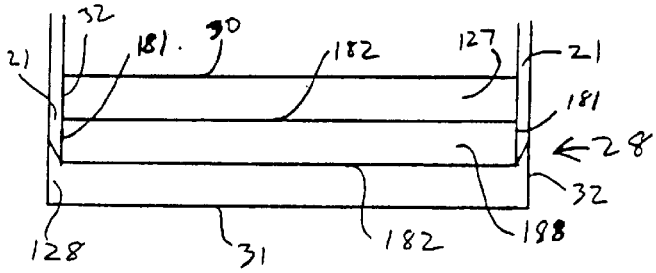

FIGS. 9A–C show a series of conventional shoe sole cross sections in the frontal plane at the heel utilizing both sagittal plane and horizontal plane sipes, and in which some or all of the sipes do not originate from any outer shoe sole surface, but rather are entirely internal. Relative motion between internal surfaces is thereby made possible to facilitate the natural deformation of the shoe sole. The intent of the general invention shown in FIG. 9 is to create a similar but simplified and more conventional version of the some of the basic principles used in the unconventional and highly anthropomorphic invention shown in FIGS. 9 and 10 of the prior application No. '302, so that the resulting functioning is similar.

FIG. 9A shows a group of three lamination layers, but unlike FIG. 6C the central layer 188 is not glued to the other surfaces in contact with it; those surfaces are internal deformation slits in the sagittal plane 181 and in the horizontal plane 182, which encapsulate the central layer 188, either completely or partially. The relative motion between lamination layers at the deformation slits 181 and 182 can be enhanced with lubricating agents, either wet like silicone or dry like teflon, of any degree of viscosity; shoe sole materials can be closed cell if necessary to contain the lubricating agent or a non-porous surface coating or layer can be applied. The deformation slits can be enlarged to channels or any other practical geometric shape as sipes defined in the broadest possible terms.

The relative motion can be diminished by the use of roughened surfaces or other conventional methods, including velco-like attachments, of increasing the coefficient of friction between lamination layers. If even greater control of the relative motion of the central layer 188 is desired, as few as one or many more points can be glued together anywhere on the internal deformation slits 181 and 182, making them discontinuous; and the glue can be any degree of elastic or inelastic.

In FIG. 9A, the outside structure of the sagittal plane deformation sipes 181 is the shoe upper 21, which is typically flexible and relatively elastic fabric or leather. In the absence of any connective outer material like the shoe upper shown in FIG. 9A or the elastic edge material 180 of FIG. 6C, just the outer edges of the horizontal plane deformation sipes 182 can be glued together.

FIG. 9B shows another conventional shoe sole in frontal plane cross section at the heel with a combination similar to FIG. 9A of both horizontal and sagittal plane deformation sipes that encapsulate a central section 188. Like FIG. 9A, the FIG. 9B structure allows the relative motion of the central section 188 with its encapsulating outer midsole section 184, which encompasses its sides as well as the top surface, and bottom sole 128, both of which are attached at their common boundaries 183.

This FIG. 9B approach is analogous to that in FIG. 9 of the prior application No. '302, which is the applicant's fully contoured shoe sole invention with an encapsulated midsole chamber of a pressure-transmitting medium like silicone; in this conventional shoe sole case, however, the pressure-transmitting medium is a more conventional section of typical shoe cushioning material like PV or EVA, which also provides cushioning.

FIG. 9C is also another conventional shoe sole in frontal plane cross section at the heel with a combination similar to FIGS. 9A and 9B of both horizontal and sagittal plane deformation sipes. However, instead of encapsulating a central section 188, in FIG. 9C an upper section 187 is partially encapsulated by deformation sipes so that it acts much like the central section 188, but is more stable and more closely analogous to the actual structure of the human foot.

Figure 10:
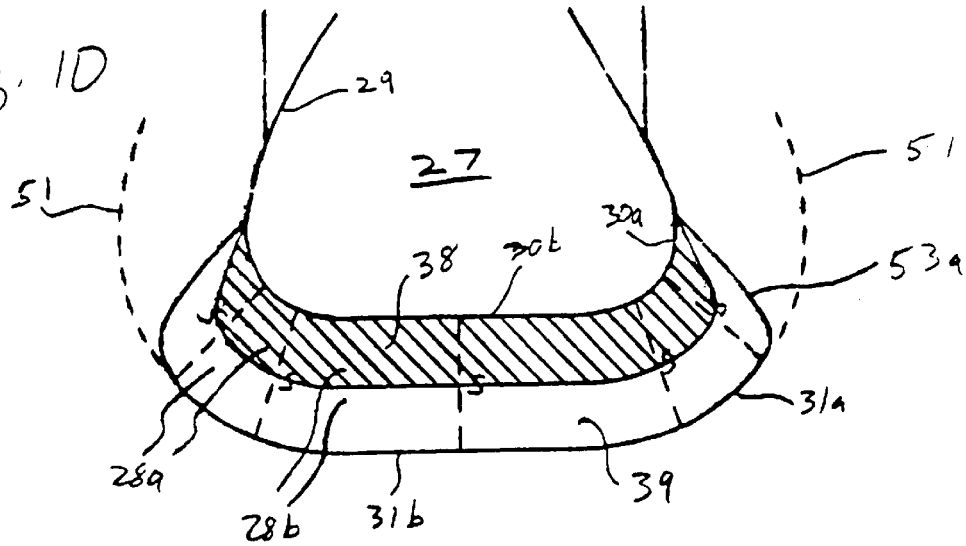
FIG. 10 shows, in frontal plane cross section at the heel portion of a shoe, the applicant's prior invention of a shoe sole with naturally contoured sides based on a theoretically ideal stability plane.

That structure was applied to shoe sole structure in FIG. 10 of prior application No. '302; the upper section 187 would be analogous to the integrated mass of fatty pads, which are U shaped and attached to the calcaneus or heel bone; similarly, the shape of the deformation sipes is U shaped in FIG. 9C and the upper section 187 is attached to the heel by the shoe upper, so it should function in a similar fashion to the aggregate action of the fatty pads. The major benefit of the FIG. 9C invention is that the approach is so much simpler and therefore easier and faster to implement than the highly complicated anthropomorphic design shown FIG. 10 of '302.

An additional note on FIG. 9C: the midsole sides 185 are like the side portion of the encapsulating midsole 184 in FIG. 9B.

Figure 9D:
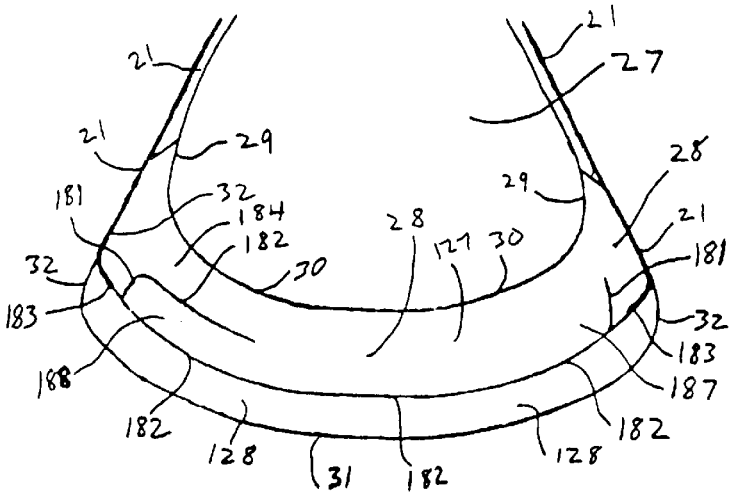
FIG. 9D shows a similar approach applied to the applicant's fully contoured design.

FIG. 9D shows in a frontal plane cross section at the heel a similar approach applied to the applicant's fully contoured design. FIG. 9D is like FIG. 9A of prior application No. '302, with the exception of the encapsulating chamber and a different variation of the attachment of the shoe upper to the bottom sole.

The left side of FIG. 9D shows a variation of the encapsulation of a central section 188 shown in FIG. 9B, but the encapsulation is only partial, with a center upper section of the central section 188 either attached or continuous with the upper midsole equivalent of 184 in FIG. 9B.

The right side of FIG. 9D shows a structure of deformation sipes like that of FIG. 9C, with the upper midsole section 187 provided with the capability of moving relative to both the bottom sole and the side of the midsole. The FIG. 9D structure varies from that of FIG. 9C also in that the deformation sipe 181 in roughly the sagittal plane is partial only and does not extend to the upper surface 30 of the midsole 127, as does FIG. 9C.

Figure 11:
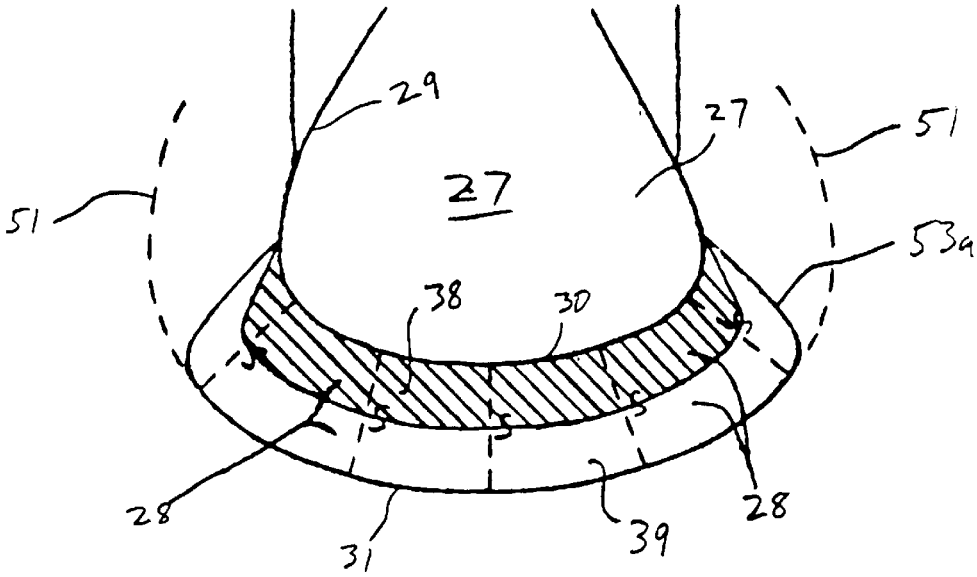
FIG. 11 shows, again in frontal plane cross section, the most general case of the applicant's prior invention, a fully contoured shoe sole that follows the natural contour of the bottom of the foot as well as its sides, also based on the theoretically ideal stability plane.

FIGS. 10 and 11 show frontal plane cross sectional views of a shoe sole according to the applicant's prior inventions based on the theoretically ideal stability plane, taken at about the ankle joint to show the heel section of the shoe. In the figures, a foot 27 is positioned in a naturally contoured shoe having an upper 21 and a sole 28. The shoe sole normally contacts the ground 43 at about the lower central heel portion thereof. The concept of the theoretically ideal stability plane, as developed in the prior application, as noted, defines the plane 51 in terms of a locus of points determined by the thickness (s) of the sole. The reference numerals are like those used in the applicant's prior inventions, as described in U.S. Pat. No. 4,989,349, issued Feb. 5, 1991, and U.S. Pat. No. 5,317,819, issued Jun. 7, 1994, as well as PCT applications published as International Publication numbers WO 90/00358, published Jan. 5, 1990; WO 91/03180, published Mar. 21, 1991; WO 91/04683, published Apr. 18, 1991; WO 91/05491, published May 2, 1991; WO91/10377, published Jul. 25, 1991; WO91/11124, published Aug. 8, 1991; and WO 91/11924, published Aug. 22, 1991 which are incorporated by reference for the sake of completeness of disclosure, if necessary.

FIG. 10 shows, in a rear cross sectional view, the application of the prior invention showing the inner surface of the shoe sole conforming to the natural contour of the foot and the thickness of the shoe sole remaining constant in the frontal plane, so that the outer surface coincides with the theoretically ideal stability plane.

FIG. 11 shows a fully contoured shoe sole design of the applicant's prior invention that follows the natural contour of all of the foot, the bottom as well as the sides, while retaining a constant shoe sole thickness in the frontal plane.

The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 11 would deform by flattening to look essentially like FIG. 10. Seen in this light, the naturally contoured side design in FIG. 10 is a more conventional, conservative design that is a special case of the more general fully contoured design in FIG. 11, which is the closest to the natural form of the foot, but the least conventional. The amount of deformation flattening used in the FIG. 10 design, which obviously varies under different loads, is not an essential element of the applicant's invention.

FIGS. 10 and 11 both show in frontal plane cross sections the essential concept underlying this invention, the theoretically ideal stability plane, which is also theoretically ideal for efficient natural motion of all kinds, including running, jogging or walking. FIG. 11 shows the most general case of the invention, the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29.

For the special case shown in FIG. 10, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole.

The theoretically ideal stability plane for the special case is composed conceptually of two parts. Shown in FIG. 10, the first part is a line segment 31*b* of equal length and parallel to line 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described.

It can be stated unequivocally that any shoe sole contour, even of similar contour, that exceeds the theoretically ideal stability plane will restrict natural foot motion, while any less than that plane will degrade natural stability, in direct proportion to the amount of the deviation. The theoretical ideal was taken to be that which is closest to natural.

Central midsole section 188 and upper section 187 in FIG. 9 must fulfill a cushioning function which frequently calls for relatively soft midsole material. Unlike the shoe sole structure shown in FIG. 9 of prior application No. '302, the shoe sole thickness effectively decreases in the FIG. 9 invention shown in this application when the soft central section is deformed under weight-bearing pressure to a greater extent than the relatively firmer sides.

In order to control this effect, it is necessary to measure it. What is required is a methodology of measuring a portion of a static shoe sole at rest that will indicate the resultant thickness under deformation. A simple approach is to take the actual least distance thickness at any point and multiply it times a factor for deformation or "give", which is typically measured in durometers (on Shore A scale), to get a resulting thickness under a standard deformation load. Assuming a linear relationship (which can be adjusted empirically in practice), this method would mean that a shoe sole midsection of 1 inch thickness and a fairly soft 30 durometer would be roughly functionally equivalent under equivalent load-bearing deformation to a shoe midsole section of ½ inch and a relatively hard 60 durometer; they would both equal a factor of 30 inch-durometers. The exact methodology can be changed or improved empirically, but the basic point is that static shoe sole thickness needs to have a dynamic equivalent under equivalent loads, depending on the density of the shoe sole material.

Since the Theoretically Ideal Stability Plane 51 has already been generally defined in part as having a constant frontal plane thickness and preferring a uniform material density to avoid arbitrarily altering natural foot motion, it is logical to develop a non-static definition that includes compensation for shoe sole material density. The Theoretically Ideal Stability Plane defined in dynamic terms would alter constant thickness to a constant multiplication product of thickness times density.

Using this restated definition of the Theoretically Ideal Stability Plane presents an interesting design possibility: the somewhat extended width of shoe sole sides that are required under the static definition of the Theoretically Ideal Stability Plane could be reduced by using a higher density midsole material in the naturally contoured sides.

Figure 12:
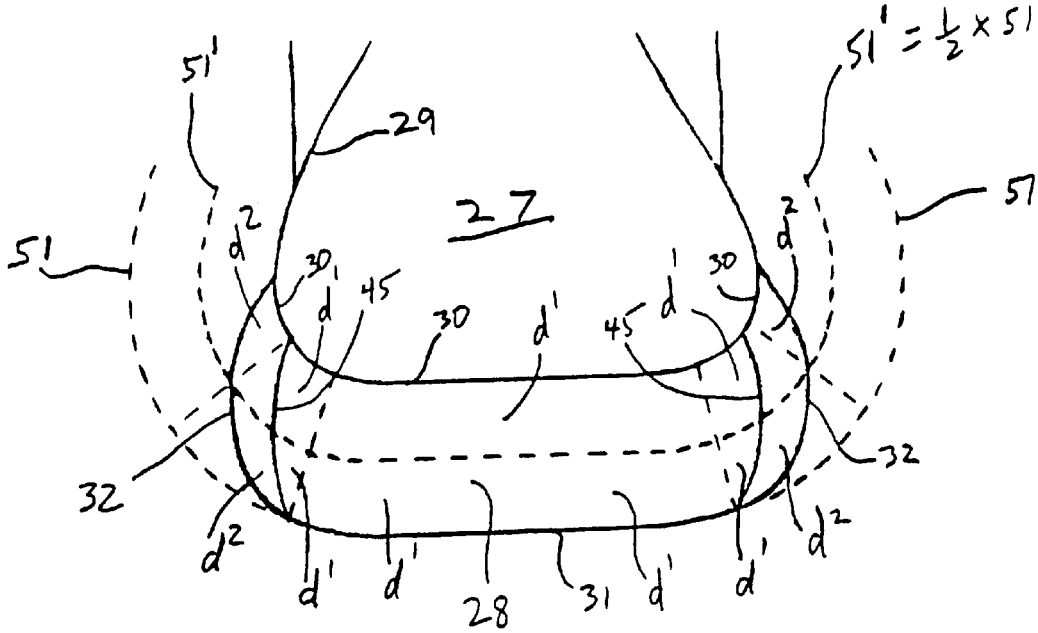
FIG. 12 shows, in frontal plane cross section at the heel, the use of a high density (d') midsole material on the naturally contoured sides and a low density (d) midsole material everywhere else to reduce side width.

FIG. 12 shows, in frontal plane cross section at the heel, the use of a high density (d') midsole material on the naturally contoured sides and a low density (d) midsole material everywhere else to reduce side width. To illustrate the principle, it was assumed in FIG. 12 that density (d') is twice that of density (d), so the effect is somewhat exaggerated to make clear, but the basic point is that shoe sole width can be reduced significantly by using the Theoretically Ideal Stability Plane with a definition of thickness that compensates for dynamic force loads. In the FIG. 12 example, about one fourth of an inch in width on each side is saved under the revised definition, for a total width reduction of one half inch, while rough functional equivalency should be maintained, as if the frontal plane thickness and density were each unchanging; again, the effect is exaggerated here to illustrate the point. Also, the line 51' parallels the Theoretically Ideal Stability Plane 51 at half the distance from the outer surface of the foot 29. Thus, for purposes of illustration, the difference between densities (d) and (d') is exaggerated. As shown in FIG. 12, the boundary between sections of different density is indicated by the line 45.

Note that the design in FIG. 12 uses low density midsole material, which is effective for cushioning, throughout that portion of the shoe sole that would be directly load-bearing from roughly 10 degrees of inversion to roughly 10 degrees, the normal range of maximum motion during running; the higher density midsole material is tapered in from roughly 10 degrees to 30 degrees on both sides, at which ranges cushioning is less critical than providing stabilizing support. Note also that the bottom sole is not shown in FIG. 12, for purposes of simplification of the illustration, but it must obviously also be included in the measurement of shoe sole thickness and density; particularly with the bottom sole, consideration must also be given to the structure, specifically the tread pattern, which can have a large impact on density in particular areas The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A shoe sole construction suitable for an athletic shoe, comprising:

a sole inner surface and a sole outer surface;

a sole lateral side, a sole medial side, and a sole middle portion located between the sole lateral side and the sole medial side; the sole including a lateral sidemost section and a medial sidemost section, each said section being located outside of a straight vertical line extending through the sole at a respective sidemost extent of said inner surface of the shoe sole, as viewed in said shoe sole frontal plane cross-section when the shoe sole is upright and in an unloaded condition;

a bottom sole;

a midsole having an inner midsole surface and an outer midsole surface;

the midsole comprising at least one convexly rounded portion of the inner midsole surface, as viewed in a frontal plane cross-section when the shoe sole is upright and in an unloaded condition, said convexity being determined relative to a section of the midsole directly adjacent to the convexly rounded portion of the inner midsole surface;

the midsole comprising at least one concavely rounded portion of the outer midsole surface, as viewed in a frontal plane cross-section when the shoe sole is upright and in an unloaded condition, said concavity being determined relative to an inner section of the midsole directly adjacent to the concavely rounded portion of the outer midsole surface;

each said concavely rounded portion of the outer midsole surface being located on a side of the shoe sole at a location corresponding to the location of at least one convexly rounded portion of the inner midsole surface so as to define a rounded portion of the midsole located between said convexly rounded portion of the inner midsole surface and said concavely rounded portion of the outer midsole surface;

the midsole extending from the sole middle portion into the sidemost section of the shoe sole side at the location of the rounded portion of the mid sole, the midsole further extending up the sole side to above a level corresponding to a lowest point of an inner surface of a nearest sidemost part of the midsole, as viewed in a shoe sole frontal plane cross-section when the shoe sole is upright and in an unloaded condition; and a non-vertical internal flexibility slit located within the sole portion of said sole, said flexibility slit being located between two opposing substantially parallel sole surfaces in physical contact with one another to permit relative motion between said opposing sole surfaces, as viewed in a frontal plane-cross-section when the shoe sole is upright and in an unloaded condition, to provide flexibility to said sole portion when under load.

2. A shoe sole as claimed in claim 1, further comprising a second internal flexibility slit that is substantially vertical, as viewed in a frontal plane cross-section when the shoe sole is upright and in an unloaded condition.

3. A shoe sole as claimed in claim 2, wherein substantially vertical portion of said internal flexibility slit is located in said rounded side portion of the midsole, as viewed in a frontal plane cross-section when the shoe sole is upright and in an unloaded condition.

4. A shoe sole as claimed in claim 1, wherein the non-vertical internal flexibility slit extends in a direction substantially parallel to the inner midsole surface, as viewed in a frontal plane cross-section when the shoe sole is upright and in an unloaded condition.

5. A shoe sole as claimed in claim 1, wherein the non-vertical internal flexibility slit extends in a direction substantially parallel to the outer midsole surface, as viewed in a frontal plane cross-section when the shoe sole is upright and in an unloaded condition.

6. The shoe sole as claimed in claim 5, wherein said frontal plane cross-section is located in a heel area of the shoe sole.

7. A shoe sole as claimed in claim 1, wherein the non-vertical internal flexibility slitextends in a direction substantially parallel to a boundary between the midsole and the bottom sole, as viewed in a frontal plane cross-section when the shoe sole is upright and in an unloaded condition.

8. A shoe sole as claimed in claim 1, wherein the non-vertical internal flexibility slit extends through the sole middle portion in a direction substantially parallel to the inner midsole surface, as viewed in a frontal plane cross-section when the shoe sole is upright and in an unloaded condition.

9. A shoe sole as claimed in claim 8, wherein the non-vertical internal flexibility slit extends from one side of the shoe sole through the sole middle portion and into the opposite side of the shoe sole, as viewed in a frontal plane cross-section when the shoe sole is upright and in an unloaded condition.

10. The shoe sole as claimed in claim 9, wherein the non-vertical internal flexibility slit forms a boundary between the midsole and the bottom sole.

11. The shoe sole as claimed in claim 9, wherein the second internal flexibility slit forms a boundary between the midsole and the bottom sole.

12. A shoe sole as claimed in claim 8, further comprising a second internal flexibility slit which extends in a direction which is substantially perpendicular to the direction of a portion of said non-vertical internal flexibility slit that is located closest to said second internal flexibility slit, as viewed in a frontal plane cross-section when the shoe sole is upright and in an unloaded condition.

13. The shoe sole as claimed in claim 12, wherein the second internal flexibility slit is oriented substantially parallel to a part of the outer midsole surface, as viewed in a frontal plane cross-section when the shoe sole is upright and in an unloaded condition.

14. The shoe sole as claimed in claim 12, wherein the second internal flexibility slit is oriented substantially parallel to a part of the outer surface of the shoe sole side, as viewed in a frontal plane cross-section when the shoe sole is upright and in an unloaded condition.

15. A shoe sole as claimed in claim 12, wherein the second internal flexibility slit is located in a midsole portion of the shoe sole.

16. A shoe sole as claimed in claim 12, further comprising a third internal flexibility slit located in a midsole portion of the shoe sole.

17. The shoe sole as claimed in claim 16, further comprising a fourth internal flexibility slit located in a midsole portion and wherein the fourth internal flexibility slit is substantially vertical, as viewed in a frontal plane cross-section when the shoe sole is upright and in an unloaded condition.

18. The shoe sole as claimed in claim 17, wherein the fourth internal flexibility into the rounded portion of the midsole, as viewed in a frontal plane cross-section when the shoe sole is upright and in an unloaded condition.

19. A shoe sole as claimed in claim 16, wherein the third internal flexibility slit extends in a direction substantially parallel to said non-vertical internal flexibility slit, as viewed in a frontal plane cross-section when the shoe sole is upright and in an unloaded condition.

20. A shoe sole as claimed in claim 16, wherein said third internal flexibility slit extends in a direction substantially parallel to the inner midsole surface, as viewed in a frontal plane cross-section when the shoe sole is upright and in an unloaded condition.

21. A shoe sole as claimed in claim 16, wherein said third internal flexibility slit extends from a side of the midsole portion to a location closer to a centerline of the shoe sole to thereby partially encapsulate a portion of the midsole within said non-vertical, second and third internal flexibility slits, as viewed in a frontal plane cross-section when the shoe sole is upright and in an unloaded condition.

22. A shoe sole as claimed in claim 16, wherein said second internal flexibility slit connects to said non-vertical internal flexibility slit.

23. A shoe sole as claimed in claim 22, wherein said third internal flexibility slit connects to said second internal flexibility slit to thereby at least partially encapsulate a portion of the midsole between said non-vertical, second and third internal flexibility slits, as viewed in a frontal plane cross-section when the shoe sole is upright and in an unloaded condition.

24. A shoe sole as claimed in claim 1, wherein the convexly rounded portion of the inner midsole surface extends into the sole middle portion, as viewed in a frontal plane cross-section when the shoe sole is upright and in an unloaded condition.

25. A shoe sole as claimed in claim 1, wherein the convexly rounded portion of the inner midsole surface extends to a centerline of the shoe sole, as viewed in a frontal plane cross-section when the shoe sole is upright and in an unloaded condition.

26. A shoe sole as claimed in claim 1, wherein the convexly rounded portion of the inner midsole surface extends through the sole middle portion, as viewed in a frontal plane cross-section when the shoe sole is upright and in an unloaded condition.

27. A shoe sole as claimed in claim 1, wherein the convexly rounded portion of the inner midsole surface extends through the sole middle portion and into the opposite side of the midsole, as viewed in a frontal plane cross-section when the shoe sole is upright and in an unloaded condition.

28. A shoe sole as claimed in claim 1, wherein at least a portion of an internal surface created by the at least one internal slit is non-porous and the shoe sole further comprises at least one lubricating agent between the non-porous portion of the internal surface created by the at least one internal slit and another internal surface of the at least one internal slit.

29. The shoe sole as claimed in claim 1, wherein the concavely rounded portion of outer midsole surface extends through the sidemost extent of a side of the midsole, as viewed in a frontal plane cross-section when the shoe sole is upright and in an unloaded condition.

30. The shoe sole as claimed in claim 1, wherein the concavely rounded portion of the outer midsole surface extends through a lowermost section of a side of the midsole, as viewed in a frontal plane cross-section when the shoe sole is upright and in an unloaded condition.

31. The shoe sole as claimed in claim 1, wherein the concavely rounded portion of the outer midsole surface extends from a lowermost section of a side of the midsole to the sidemost extent of the same side of the midsole, as viewed in a frontal plane cross-section when the shoe sole is upright and in an unloaded condition.

32. The shoe sole as claimed in claim 1, wherein the concavely rounded portion of the outer midsole surface extends from a lowermost section of a side of the midsole to above a lowermost point of the inner surface of the midsole, as viewed in a frontal plane cross-section when the shoe sole is upright and in an unloaded condition.

33. The shoe sole as claimed in claim 1, wherein the concavely rounded portion of the outer midsole surface extends into the sole middle portion, as viewed in a frontal plane cross-section when the shoe sole is upright and in an unloaded condition.

34. The shoe sole as claimed in claim 1, wherein the concavely rounded portion of the outer midsole surface extends through the sole middle portion, as viewed in a frontal plane cross-section when the shoe sole is upright and in an unloaded condition.

35. The shoe sole as claimed in claim 1, wherein the internal flexibility slit is continuous and partially encapsulates a part of the midsole portion, as viewed in a frontal plane cross-section when the shoe sole is upright and in an unloaded condition.

36. The shoe sole as claimed in claim 1, wherein the internal flexibility slit is oriented substantially parallel to a horizontal plane cross-section.

* * * * *